US007472069B2

(12) United States Patent
Takagi et al.

(10) Patent No.: US 7,472,069 B2
(45) Date of Patent: Dec. 30, 2008

(54) APPARATUS FOR PROCESSING FRAMED AUDIO DATA FOR FADE-IN/FADE-OUT EFFECTS

(75) Inventors: Koichi Takagi, Saitama (JP); Shigeyuki Sakazawa, Saitama (JP)

(73) Assignee: KDDI Corporation, Tokyo (JP)

( * ) Notice: Subject to any disclaimer, the term of this patent is extended or adjusted under 35 U.S.C. 154(b) by 681 days.

(21) Appl. No.: 11/073,639

(22) Filed: Mar. 8, 2005

(65) Prior Publication Data

US 2005/0234714 A1 Oct. 20, 2005

(30) Foreign Application Priority Data

Apr. 5, 2004 (JP) ..... 2004-111028

(51) Int. Cl.
*G10L 19/00* (2006.01)

(52) U.S. Cl. ..... 704/503

(58) Field of Classification Search ..... 704/503
See application file for complete search history.

(56) References Cited

U.S. PATENT DOCUMENTS 6,985,856 B2 * 1/2006 Wang et al. ..... 704/226
7,272,566 B2 * 9/2007 Vinton ..... 704/500

FOREIGN PATENT DOCUMENTS

JP 7-220394 8/1995

* cited by examiner

*Primary Examiner*—Susan McFadden
(74) *Attorney, Agent, or Firm*—Oblon, Spivak, McClelland, Maier & Neustadt, P.C.

(57) ABSTRACT

An apparatus that process framed audio data to add fade-in and/or fade-out effect with low computing speed and small memory. The apparatus includes a deframer for taking an original value of a first gain parameter from an input audio frame, a first gain parameter adjuster for adjusting the first gain parameter based on the original value for a preset duration, and a framer for generating an output audio frame, which has the adjusted value for the first gain parameter.

21 Claims, 8 Drawing Sheets

| VALUE OF SAMPLE | 4 | 2 | 1 | 3 |
|---|---|---|---|---|

APPARATUS FOR PROCESSING FRAMED AUDIO DATA FOR FADE-IN/FADE-OUT EFFECTS

PRIORITY CLAIM

This application claims priority from Japanese patent application No. 2004-111028, filed on Apr. 5, 2004, which is incorporated herein by reference.

BACKGROUND OF THE INVENTION

1. Field of the Invention

The present invention relates to an audio data processing apparatus for fade-in and/or fade-out effects.

2. Description of the Related Art

For music distribution via the Internet, normally audio signal is encoded using compression coding. One typical compression format for audio data is MP3 (ISO/IEC11172-3) of the Motion Picture Expert Group Phase 1 (MPEG1). Another typical format is ISO/IEC 13818 and ISO/IEC14496, also known as AAC (Advanced Audio Coding) of the Motion Picture Expert Group phase 2 (MPEG2) standard, which can encodes audio signal with 20% to 50% less data than MP3, although AAC is not compatible with MP3. Since AAC makes it possible to express the high quality audio signal with a small amount of data, it has been widely used for music distribution.

Nowadays the playback of music is done at variety of situations. For example, it is replayed as ring tone of cellular phone and/or as alarm sound of scheduler function implemented in PDA or cellular phone. In this situation, fade-in and/or fade-out effects are desirable to make ring tone and/or alarm sound comfortable, and to avoid sudden loud sound.

Japanese patent publication No. 7-220394A discloses a method of processing encoded audio data for fade-in and fade-out effects. According to the method, fade-in is achieved by the step of, decoding the first n samples of data, increasing the amplitude of decoded PAM (Pulse Amplitude Modulation) samples gradually, and encoding the PAM samples again. According to the method, fade-out is achieved by the step of, decoding the last n samples of data, decreasing the amplitude of decoded PAM samples gradually, and encoding PAM samples again.

However, according to the above-mentioned method, it requires high computing speed and large memory size for decoding audio data, changing the amplitude of PAM samples to change the volume of audio signal as time advances, and encoding the PAM samples again. Since the computing speed and memory size of cellular phone are limited, it is difficult to perform above-mentioned method on a cellular phone.

BRIEF SUMMARY OF THE INVENTION

The invention has been made in view of the above-mentioned problem, and it is therefore an object of the present invention to provide an apparatus that can add the fade-in and/or fade-out effects to audio signal without decoding the framed audio data completely, which is encoded by compression coding, therefore does not require high computing speed and large memory.

According to the present invention, the apparatus for processing framed audio data for fade-in and/or fade-out effects includes deframer for taking an original value of a first gain parameter from an input audio frame, first gain parameter adjuster for adjusting the first gain parameter based on the original value for preset duration, and framer for generating an output audio frame, which has the adjusted value for the first gain parameter.

Since only the first gain parameter is adjusted to add fade-in and/or fade-out effects, it does not require high computing speed and large memory, therefore, it is possible to implement on the device with low computing speed and small memory, such as cellular phone.

Favorably, the input audio frame has audio data encoded by AAC, and the first gain parameter is a global-gain.

Advantageously, the deframer further takes a scale factor from the input audio frame, and the apparatus further includes range checker for determining the minimum value of quantization step based on the scale factor and the original value of global-gain, and the first gain parameter adjuster calculates the minimum value for the global-gain by subtracting the minimum value of quantization step from the original value of global-gain, and keeps the global-gain above the minimum value for the global-gain.

According to another aspect of the present invention, the deframer further takes values in a second gain parameter from the input audio frame, and the apparatus further includes second gain parameter adjuster for adjusting the second gain parameter for preset duration, and the framer generates the output audio frame, which has the adjusted values for the second gain parameter.

Favorably, the input audio frame has audio data encoded by both AAC and SBR, and the first gain parameter is a global-gain, and the second gain parameter is a bs_data_env.

To process both first and second gain parameter simultaneously, it is possible to handle the framed audio data, which is encoded not only for AAC, but also both AAC and SBR.

Advantageously, the first gain parameter adjuster changes the first gain parameter based on a preset function of time.

Therefore, the user can configure fade-in and/or fade-out method as his or her favorite way.

According to further aspect of the present invention, the apparatus is implemented by computer program, which is stored on a computer readable media.

DETAILED DESCRIPTION OF THE INVENTION

An embodiment of the present invention will be described below with reference to the drawings.

Figure 1:
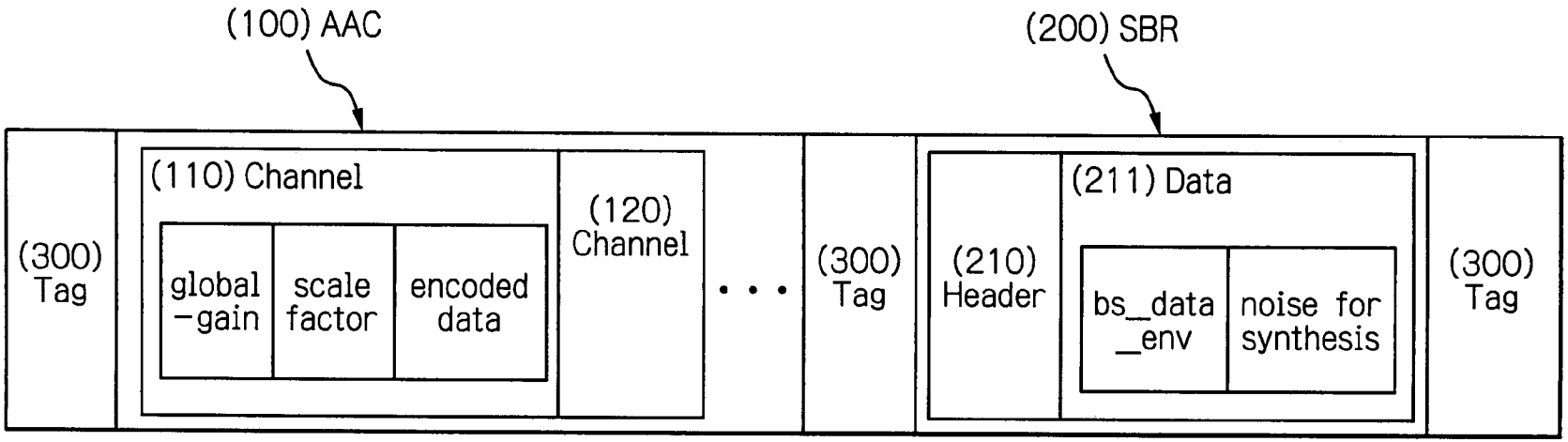
FIG. 1 shows an audio frame structure.

FIG. 1 shows an audio frame structure encoded by AAC and SBR. According to the audio frame based on MPEG standard, the frame has an AAC field 100 and a SBR (Spectral Band Replication) field 200 separated by tag fields 300. The AAC field 100 comprises a number of channel fields, for example a right channel field 110 and a left channel field 120, and each channel field has data for lower frequency band of the audio signal, while the SBR field 200 has data for higher frequency band of the audio signal.

Each channel field has a global-gain and a scale factor, in addition to encoded data, which is compressed data for audio signal. The scale factor is an array, and has plurality of values, each of which is corresponding to each sub-band of audio signal. Each value in the scale factor is a differential value relative to the value of previous position, and is encoded using Huffman code, and therefore before processing the scale factor, Huffman decoding should be performed.

SBR is a method to improve the quality of audio signal by replicating higher frequency band signal using lower frequency band signal at decoder. SBR method makes it possible to achieve the same signal quality of high bit rate AAC with low bit rate, because SBR method requires only a small amount of data for replication, in addition to the data for lower frequency band signal encoded by AAC. The SBR field 200 of the audio frame comprises a header field 210 and a data field 211, and the data field 211 contains a bs_data_env and a noise for synthesis. The bs_data_env is an array, and has plurality of values, each of which is corresponding to each sub-band of higher frequency band of audio signal. Each value in the bs_data_env is encoded using Huffman code, and therefore before processing the bs_data_env, Huffman decoding should be performed.

In case of AAC encoding only, audio frame has only AAC field 100, which has data for entire frequency band of audio signal.

Figure 2:
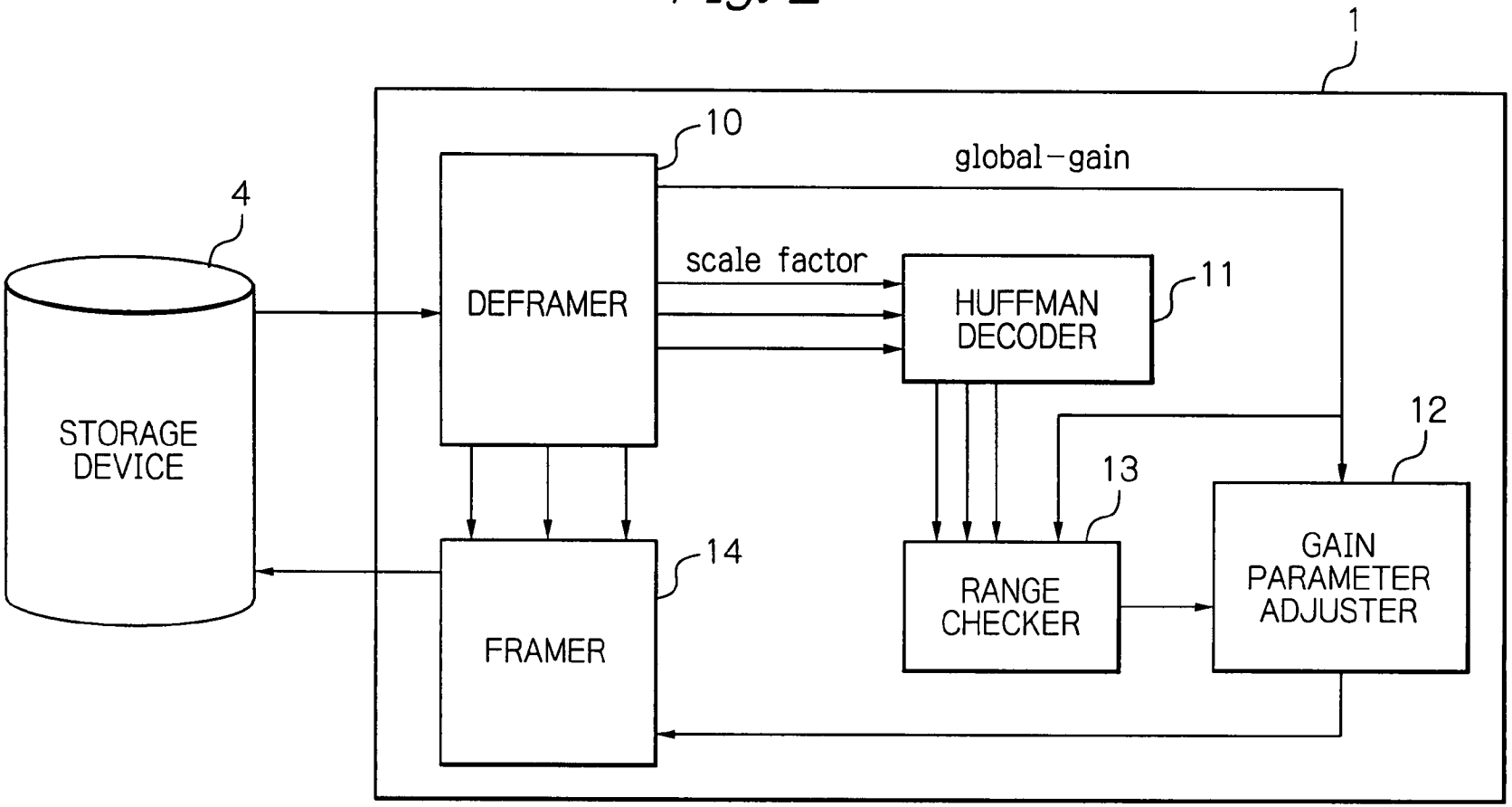
FIG. 2 is a block diagram of an apparatus for processing framed audio data encoded by AAC for fade-in/fade-out effects according to the present invention.

FIG. 2 is a block diagram of an apparatus 1 for processing framed audio data encoded by AAC for fade-in/fade-out effects according to the present invention. Advantageously, these functions in FIG. 2 are realized by computer program.

Audio frames containing the data encoded by AAC are input from a storage device 4 to the apparatus 1, and after fade-in and/or fade-out processing is performed, audio frames are output to the storage device 4. A deframer 10 terminates an input audio frame, and outputs a global-gain included in the input audio frame to a gain parameter adjuster 12 and a range checker 13, outputs a scale factor included in the input audio frame to a Huffman decoder 11. Also the deframer 10 outputs the input audio frame or all data except for global-gain to a framer 14. The Huffman decoder 11 decodes the scale factor, each value of which is encoded by Huffman code, and outputs decoded value of the scale factor to the range checker 13.

The gain parameter adjuster 12 has information about operation mode, which indicates what effect adds to audio signal, that is, fade-in, fade-out or both, as well as duration for fade-in and/or fade-out. The user presets this information to the apparatus 1. For fade-in operation, the gain parameter adjuster 12 gradually increases the value of global-gain for the duration preset by the user when preset duration expired, the value of global-gain reaches the nominal or original value, which is the value that the deframer 10 input. Then the gain parameter adjuster 12 outputs changed global-gain to the framer 14. Similarly, for the fade-out operation, the gain parameter adjuster 12 gradually decreases the value of global-gain for the preset duration from the original value of global-gain.

In other words, the gain parameter adjuster 12 gets a global-gain, every time an audio frame is input to the apparatus 1. Then the gain parameter adjuster 12 changes or adjusts the value of global gain for each audio frame included in the fade-in and/or fade-out duration preset by the user from the value for previous frame. Then the gain parameter adjuster 12 outputs each value of global-gain for each audio frame to the framer 14.

As described later, there is the minimum value for the global-gain, therefore, the gain parameter adjuster 12 uses the value for the global-gain between the minimum value and the original value. If code length becomes shorter due to value change for the global-gain at the gain parameter adjuster 12, the framer 14 can insert stuffing bits to keep code length.

The range checker 13 calculates each quantization step for each frequency band based on the values of scale factor and the original value of global-gain, and outputs the minimum value of quantization step to the gain parameter adjuster 12. The gain parameter adjuster 12 calculates the minimum value for the global-gain by subtracting the minimum value of quantization step informed by the range checker 13 from the original value of global-gain informed by the deframer 10, and works to keep the value of global-gain above the minimum value. Consequently, it prevents the quantization step from having a negative value.

Following is an example, in case of global-gain=15 scale factor=0, −2, −1, −2, +4

In this case, each quantization step is as follows.

quantization step=15, 13, 12, 10, 14

If the gain parameter adjuster 12 changes the value of global-gain as follows.

global-gain=3 then each quantization step is as follows.

quantization step=3, 1, 0, −2, 2

Thus it has a negative value. To prevent negative value of quantization step, the range checker 13 informs the minimum value of quantization step based on the original value of global-gain, i.e. 10 in this case, to the gain parameter adjuster 12. The gain parameter adjuster 12 calculates the minimum value for the global-gain as follows.

the minimum value for the global-gain=15−10=5

Where 15 is the original value of global-gain informed by the deframer 10. If the minimum value, i.e. 5, is used for the global-gain, each quantization step is as follows.

quantization step=5, 3, 2, 0, 4

The gain parameter adjuster 12 outputs changed global-gain to the framer 14.

The framer 14 encodes the value of global gain from the gain parameter adjuster 12, and generates an output audio frame based on the encoded global-gain with the frame or data from the deframer 10. Then the framer 14 outputs it to the storage device 4. Output audio frames not included in the fade-in and/or fade-out period are the same as the corresponding input audio frame. Output audio frames included in the fade-in and/or fade-out period are the same as the corresponding input audio frame except for the global-gain in the AAC field 100.

Figure 3:
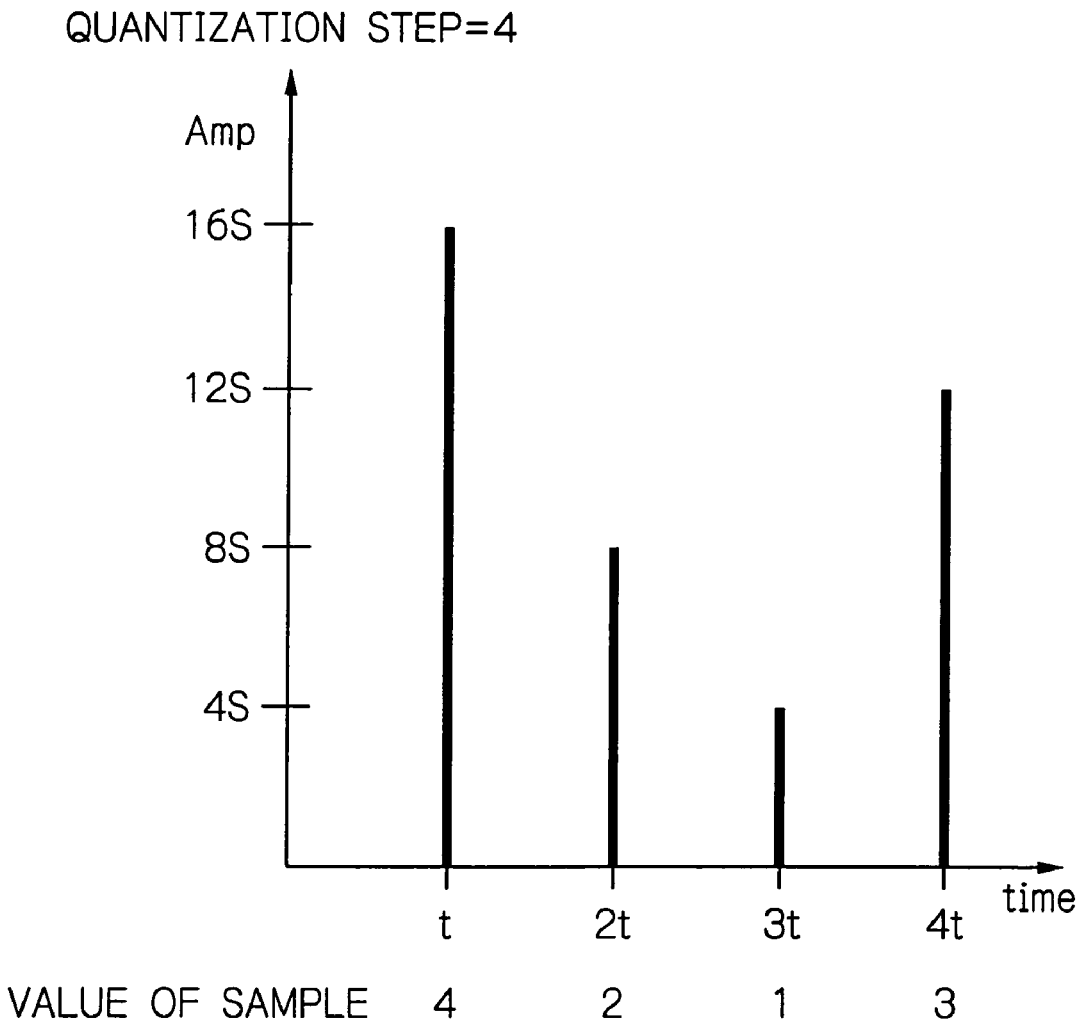
FIG. 3 shows output amplitude of samples.

FIG. 3 shows output amplitude of samples for one frequency band, where quantization step is 4. Abscissa axis shows the time, and longitudinal axis shows the amplitude of output signal. Value of each sample, which is obtained by decoding the encoded data in the AAC field 100, at time t, 2t, 3t and 4t are respectively 4, 2, 1 and 3, and output amplitude of time t, 2t, 3t and 4t are respectively 16S, 8S, 4S and 12S.

Figure 4:
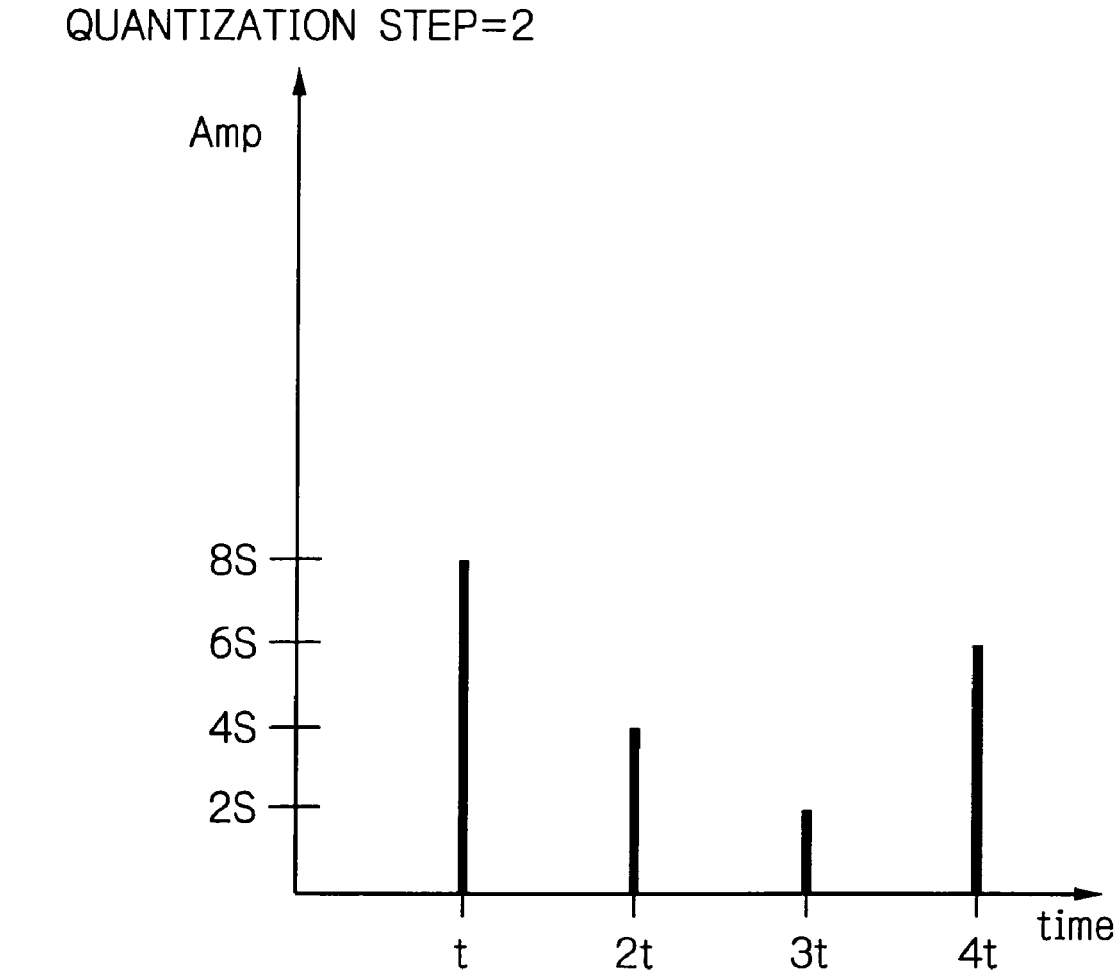
FIG. 4 shows output amplitude of the same samples indicated in FIG. 3 with a half quantization step.

FIG. 4 shows output amplitude of the same samples indicated in FIG. 3, but quantization step is 2. Output amplitude of time t, 2t, 3t and 4t are respectively 8S, 4S, 2S and 6S. Amplitude of each sample is a half compared to the one indicated in FIG. 3.

Figure 5:
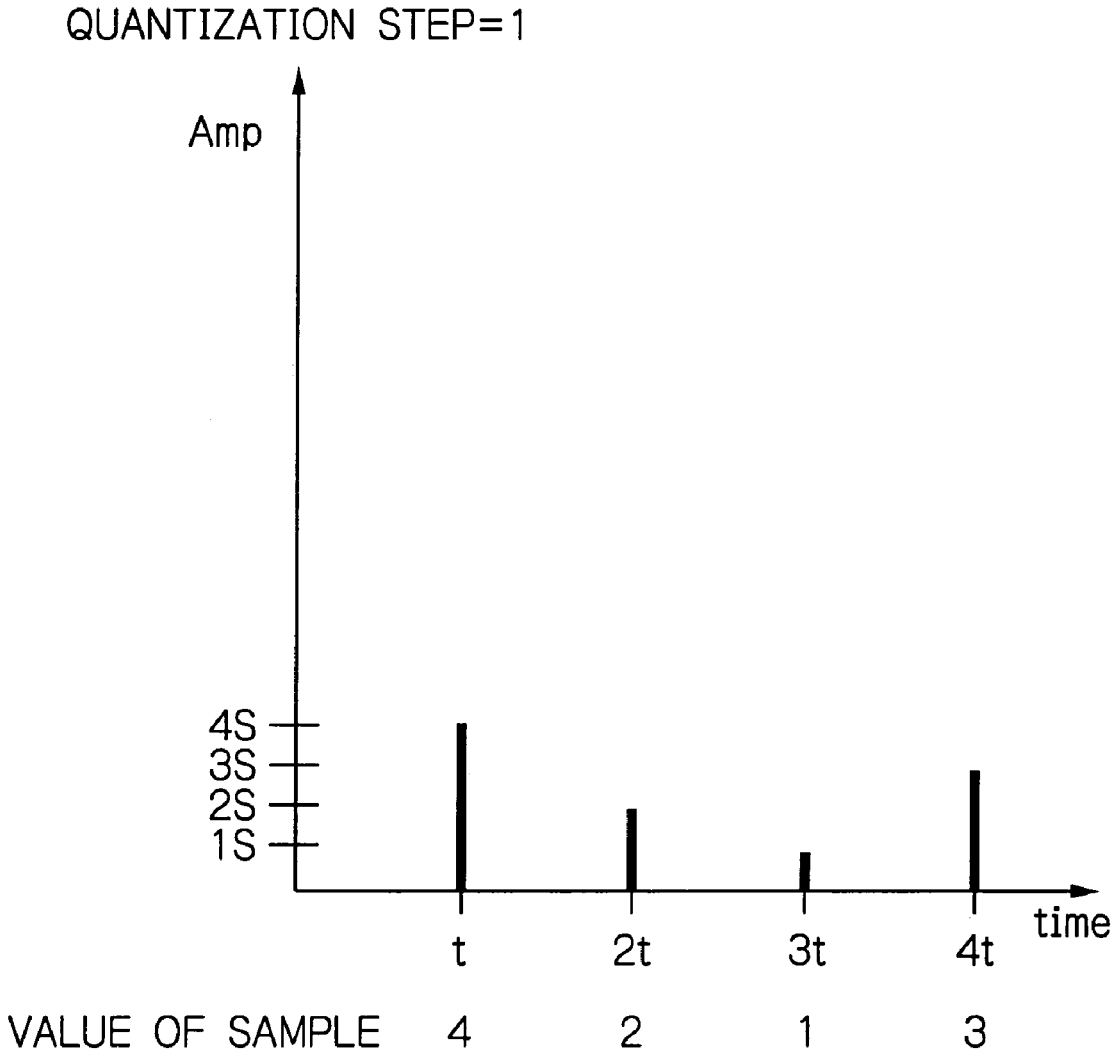
FIG. 5 shows output amplitude of the same samples indicated in FIG. 3 with a quarter quantization step.

FIG. 5 shows output amplitude of the same samples indicated in FIG. 3, but quantization step is 1. Output amplitude of time t, 2t, 3t and 4t are respectively 4S, 2S, S and 3S. Amplitude of each sample is a quarter compared to the one indicated in FIG. 3.

As shown in FIG. 3 to FIG. 5, increase of quantization step means fade-in operation, and decrease of quantization step means fade-out operation. It is possible to control the volume of sounds by changing quantization step, which can be controlled by the value of global-gain. Thus it is possible to control the volume by controlling the global-gain, without decoding the encoded data, which is placed on each channel field of the AAC field 100.

Figure 6:
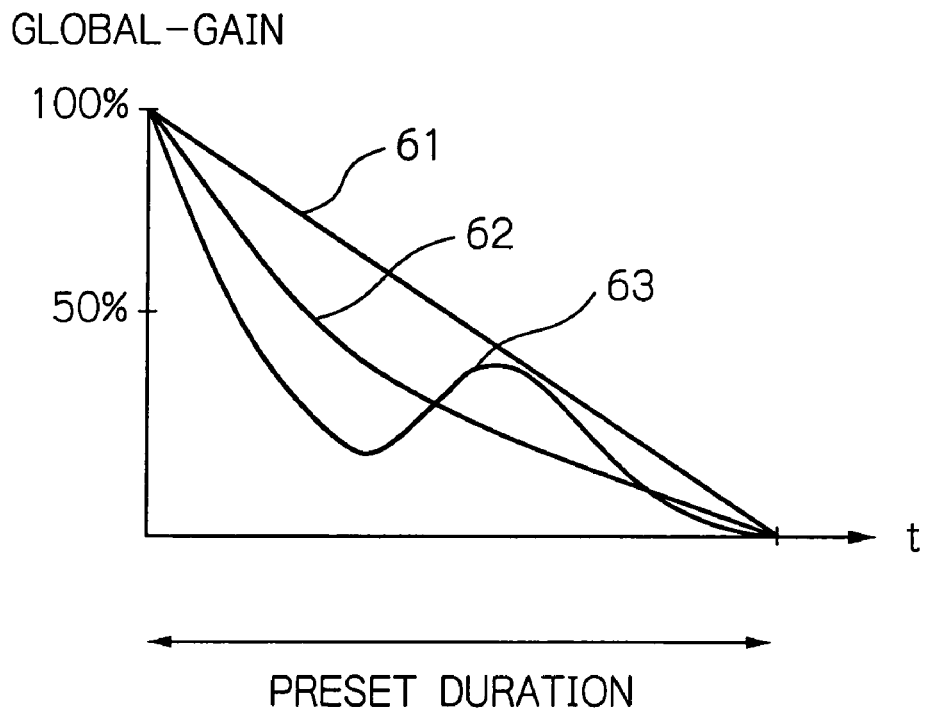
FIG. 6 shows the variations of fade-out method.

FIG. 6 shows the variations of fade-out method. In FIG. 6 abscissa axis shows the time, and longitudinal axis shows the global-gain, which is proportional to the volume of the sound. A line 61 shows that the volume is turned down linearly as time advances. A line 62 shows that the volume is turned down exponentially. A line 63 shows that the volume is turned down, and turned up for short time, and then turned down again. The user can configure any line, which is a function of time, for fade-in and/or fade-out, and it is the design matter.

Figure 7A:
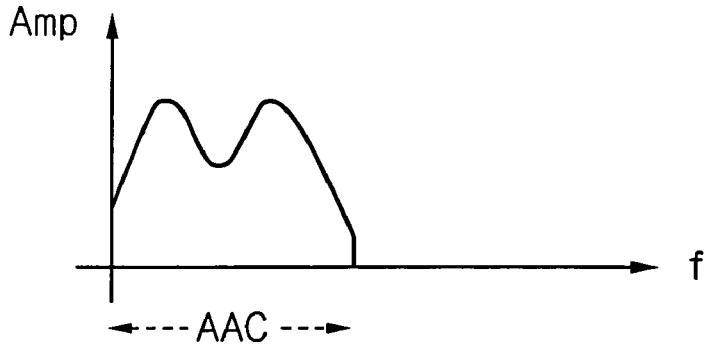
FIG. 7A shows audio signal generated by the data in the AAC field at frequency domain.
Figure 7B:
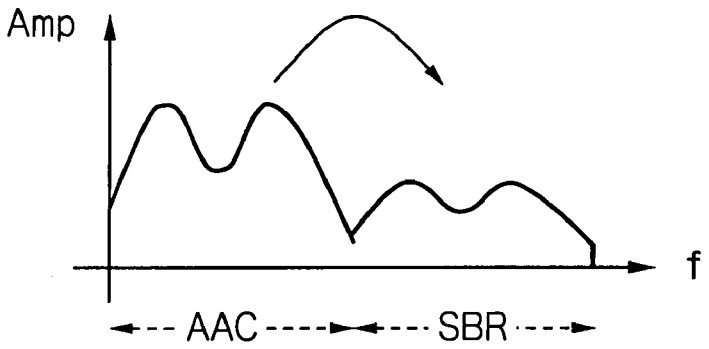
FIG. 7B shows audio signal, higher frequency band of which is a replication of lower frequency band signal indicated in FIG. 7A.
Figure 7C:
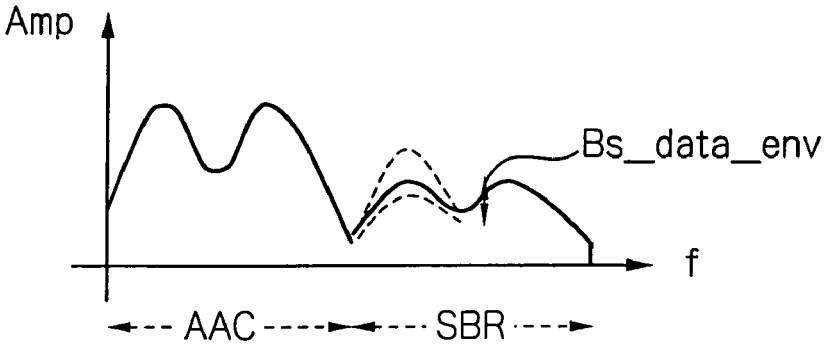
FIG. 7C shows audio signal, higher frequency band of which is adjusted by the bs_data_env in the SBR field from the signal indicated in FIG. 7B.

FIG. 7A shows audio signal generated by the data in the AAC field 100 at frequency domain, and FIG. 7B shows audio signal, higher frequency band of which is a replication of lower frequency band signal indicated in FIG. 7A, and FIG. 7C shows audio signal, higher frequency band of which is adjusted by the bs_data_env in the SBR field 200 from the signal indicated in FIG. 7B.

As indicated in FIG. 7A to 7C, it is possible to control the volume of higher frequency band of the sound by the bs_data_env. Therefore it is possible to control the volume of the sound, which is encoded by both AAC and SBR, by controlling the global-gain and the bs_data_env.

Figure 8:
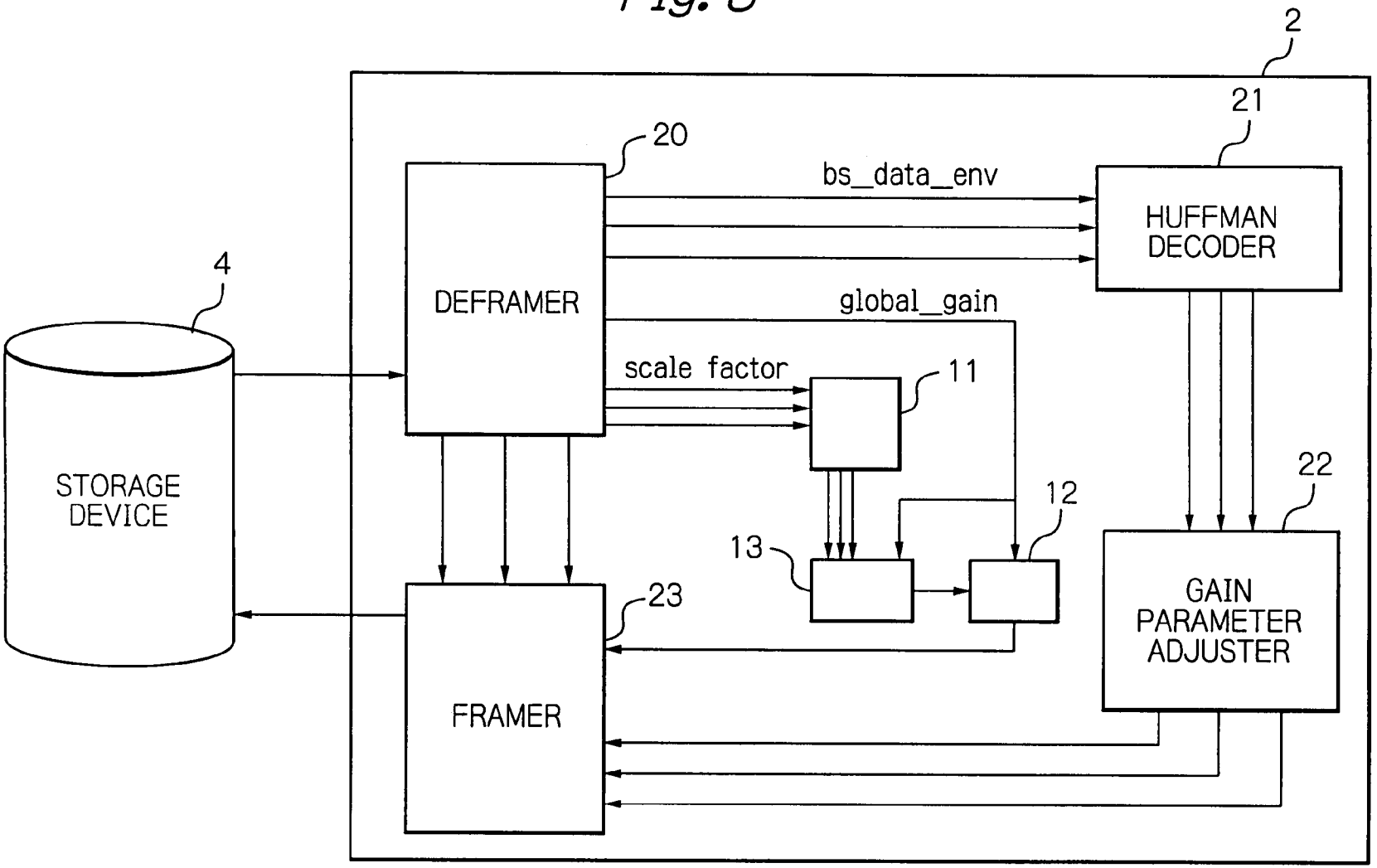
FIG. 8 is a block diagram of an apparatus for processing framed audio data encoded by AAC and SBR for fade-in/fade-out effects according to the present invention.

FIG. 8 is a block diagram of an apparatus 2 for processing framed audio data encoded by AAC and SBR for fade-in and/or fade-out effects according to the present invention. Advantageously, these functions are realized by computer program.

Audio frames containing the data encoded by AAC and SBR are input from the storage device 4 to the apparatus 2, and after fade-in and/or fade-out processing is performed, audio frames are output to the storage device 4. A deframer 20 terminates an input frame, and output a global-gain included in the input frame to the gain parameter adjuster 12 and the range checker 13, outputs a scale factor to the Huffman decoder 11, outputs a bs_data_env to a Huffman decoder 21. Also the deframer 20 outputs the input frame or all data except for the global-gain and the bs_data_env to a framer 23. The Huffman decoder 11, the gain parameter adjuster 12 and the range checker 13 is the same as indicated in FIG. 2, and has the same function as mentioned above. The Huffman decoder 21 decodes the bs_data_env, each value of which is encoded by Huffman code and is corresponding to each subband of higher frequency band. The Huffman decoder 21 outputs decoded bs_data_env to a gain parameter adjuster 22. The gain parameter adjuster 22 has the information as same as the gain parameter adjuster 12, i.e. operation mode and duration for fade-in/fade-out, and changes the each value in the bs_data_env, and encoding the changed values using Huffman code, and then outputs to the framer 23.

The framer 23 encodes the value of global-gain from the gain parameter 12, and generates an output frame using the encoded global-gain and the bs_data_env input from the gain parameter adjuster 22 with the frame or data from the deframer 20. Then the framer 20 outputs it to the storage device 4. If code length for the global-gain or the bs_data_env is shortened due to value change, the framer 23 can insert stuffing bits to keep code length. For fade-out operation, if the Huffman code for the bs_data_env from the gain parameter adjuster 22 is lengthened due to value change, the framer 23 can change the value in the bs_data_env to the one, which causes lower volume of the sounds and has the same or shorter code length. To do this, it prevents output frames from having longer frame length than the corresponding input frame. The output frame is the same as the corresponding input frame except for the global-gain in the AAC field 100 and bs_data_env in the data field 211.

The embodiment described here is given merely as example, and a person skilled in the art can implement other embodiments of the invention, which are within the scope of the invention.

The invention claimed is:

1. An apparatus for processing framed audio data for fade-in and/or fade-out effects, comprising:

deframing means for obtaining an original value of a first gain parameter from an input audio frame;

first gain parameter adjustment means for adjusting the first gain parameter based on the original value for a preset duration;

framing means for generating an output audio frame, the output audio frame having the adjusted value for the first gain parameter, wherein data other than the first gain parameter in the output audio frame are obtained from the input audio frame without changing the original value.

2. The apparatus of claim 1, wherein said input audio frame has audio data encoded by Advanced Audio Coding, and wherein said first gain parameter is a global-gain.

3. The apparatus of claim 2, wherein said deframing means further obtains a scale factor from said input audio frame, wherein the apparatus further comprises means for determining the minimum value of a quantization step based on the scale factor and said original value of global-gain, and wherein said first gain parameter adjustment means calculates the minimum value for the global-gain by subtracting the minimum value of the quantization step from said original value of global-gain, and keeps the global-gain above the minimum value for the global-gain.

4. The apparatus of claim 1, wherein said deframe means further obtains values in a second gain parameter from said input audio frame, wherein the apparatus further comprises second gain parameter adjustment means for adjusting the second gain parameter for a preset duration, and wherein said framing means generates said output audio frame further having the adjusted values for the second gain parameter.

5. The apparatus of claim 4, wherein said input audio frame has audio data encoded by both Advanced Audio Coding and Spectral Band Replication, and wherein said first gain parameter is a global-gain and said second gain parameter is a bs_data_env.

6. The apparatus of claim 1, wherein said first gain parameter adjustment means changes the first gain parameter based on a preset function of time.

7. A computer readable medium including computer executable instructions which when executed on a computer cause the computer to process framed audio data for fade-in and/or fade-out effects, the computer executable instructions comprising:

first instruction means for obtaining an original value of a first gain parameter from an input audio frame;

second instruction means for adjusting the first gain parameter based on the original value for a preset duration; and third instruction means for generating an output audio frame, the output audio frame having the adjusted value for the first gain parameter, wherein data other than the first gain parameter in the output audio frame are obtained from the input audio frame without changing the original value.

8. The computer readable medium of claim 7, wherein said input audio frame has audio data encoded by Advanced Audio Coding, and wherein said first gain parameter is a global-gain.

9. The computer readable medium of claim 8, wherein said first instruction means further obtains a scale factor from said input audio frame, wherein the apparatus further comprises fourth instruction means for determining the minimum value of a quantization step based on the scale factor and said original value of global-gain, and wherein said second instruction means calculates the minimum value for the global-gain by subtracting the minimum value of quantization step from said original value of global-gain, and keeps the global-gain above the minimum value for the global-gain.

10. The computer readable medium of claim 7, wherein said first instruction means further obtains values in a second gain parameter from said input audio frame, wherein the apparatus further comprises fifth instruction means for adjusting the second gain parameter for a preset duration, and wherein said third instruction means generates said output audio frame further having the adjusted values for the second gain parameter.

11. The computer readable medium of claim 10, wherein said input audio frame has audio data encoded by both Advanced Audio Coding and Spectral Band Replication, wherein said first gain parameter is a global-gain and said second gain parameter is a bs_data_env.

12. The computer readable medium of claim 7, wherein said second instruction means changes the first gain parameter based on a preset function of time.

13. An apparatus for processing framed audio data for fade-in and/or fade-out effects, comprising:

a deframer that obtains an original value of a first gain parameter from an input audio frame;

a first gain parameter adjuster that adjusts the first gain parameter based on the original value for a preset duration; and a framer that generates an output audio frame, the output audio frame having the adjusted value for the first gain parameter, wherein data other than the first gain parameter in the output audio frame are obtained from the input audio frame without changing the original value.

14. The apparatus of claim 13, wherein said input audio frame has audio data encoded by Advanced Audio Coding, and wherein said first gain parameter is a global-gain.

15. The apparatus of claim 14, wherein said deframer further obtains a scale factor from said input audio frame, wherein the apparatus further comprises a range checker that determines the minimum value of a quantization step based on the scale factor and said original value of global-gain, and wherein said first gain parameter adjuster calculates the minimum value for the global-gain by subtracting the minimum value of the quantization step from said original value of global-gain, and keeps the global-gain above the minimum value for the global-gain.

16. The apparatus of claim 13, wherein said deframer further obtains values in a second gain parameter from said input audio frame, wherein the apparatus further comprises a second gain parameter adjuster that adjusts the second gain parameter for a preset duration, and wherein said framer generates said output audio frame further having the adjusted values for the second gain parameter.

17. The apparatus of claim 16, wherein said input audio frame has audio data encoded by both Advanced Audio Coding and Spectral Band Replication, and wherein said first gain parameter is a global-gain and said second gain parameter is a bs_data_env.

18. The apparatus of claim 13, wherein said first gain parameter adjuster changes the first gain parameter based on a preset function of time.

19. An apparatus for processing framed audio data for fade-in and/or fade-out effects, comprising:

a deframer that obtains an original value of a first gain parameter from an input audio frame;

a first gain parameter adjuster that adjusts the first gain parameter based on the original value for a preset duration; and a framer that generates an output audio frame, the output audio frame having the adjusted value for the first gain parameter, wherein said deframer further obtains values in a second gain parameter from said input audio frame, wherein the apparatus further comprises a second gain parameter adjuster that adjusts the second gain parameter for a preset duration, and wherein said framer generates said output audio frame further having the adjusted values for the second gain parameter.

20. The apparatus of claim 19, wherein said input audio frame has audio data encoded by both Advanced Audio Coding and Spectral Band Replication, and wherein said first gain parameter is a global-gain and said second gain parameter is a bs_data_env.

21. An apparatus for processing framed audio data for fade-in and/or fade-out effects, comprising:

a deframer that obtains an original value of a first gain parameter from an input audio frame;

a first gain parameter adjuster that adjusts the first gain parameter based on the original value for a preset duration; and a framer that generates an output audio frame, the output audio frame having the adjusted value for the first gain parameter, wherein said first gain parameter adjuster changes the first gain parameter based on a preset function of time.

* * * * *